US010399205B2

(12) United States Patent
Jaganathan et al.

(10) Patent No.: US 10,399,205 B2
(45) Date of Patent: Sep. 3, 2019

(54) SYSTEMS, APPARATUS, AND METHODS FOR CHEMICAL POLISHING

(71) Applicant: Applied Materials, Inc., Santa Clara, CA (US)

(72) Inventors: Balasubramaniam C. Jaganathan, Bangalore (IN); Rajeev Bajaj, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 59 days.

(21) Appl. No.: 15/426,039

(22) Filed: Feb. 6, 2017

(65) Prior Publication Data

US 2017/0225294 A1 Aug. 10, 2017

Related U.S. Application Data

(60) Provisional application No. 62/292,850, filed on Feb. 8, 2016.

(51) Int. Cl.
*B24B 57/02* (2006.01)
*B24B 37/20* (2012.01)

(52) U.S. Cl.
CPC ..... *B24B 57/02* (2013.01); *B24B 37/20* (2013.01)

(58) Field of Classification Search
CPC ..... B24B 37/20; B24B 57/02
See application file for complete search history.

(56) References Cited

U.S. PATENT DOCUMENTS 5,658,185 A * 8/1997 Morgan ..... B24B 37/16 438/693
5,816,900 A * 10/1998 Nagahara ..... B24B 37/24 451/285
6,300,246 B1 * 10/2001 Huynh ..... B24B 37/042 257/E21.228
6,592,439 B1 7/2003 Li et al.
6,705,928 B1 * 3/2004 Barns ..... B24B 37/26 451/285
7,604,529 B2 10/2009 Muldowney
7,632,170 B2 * 12/2009 O'Moore ..... B24B 37/26 451/288
8,128,461 B1 * 3/2012 O'Moore ..... B24B 57/02 451/285

(Continued)

FOREIGN PATENT DOCUMENTS

KR 10-2006-0002191 1/2006

OTHER PUBLICATIONS

International Search Report and Written Opinion of International Application No. PCT/US2017/016758 (23560/PCT) dated May 16, 2017.

(Continued)

*Primary Examiner* — Marc Carlson
(74) *Attorney, Agent, or Firm* — Fish & Richardson P.C.

(57) ABSTRACT

Embodiments of the present invention provide systems, apparatus, and methods for chemical polishing a substrate using a fluid network platen assembly that includes a pad having a plurality of fluid openings; a network of a plurality of fluid channels, each channel in fluid communication with at least one fluid opening; a plurality of inlets, each inlet coupled to a different fluid channel; and an outlet coupled to one of the fluid channels not coupled to an inlet. Numerous additional aspects are disclosed.

20 Claims, 11 Drawing Sheets

(56) References Cited

U.S. PATENT DOCUMENTS

| | | | | |
|---|---|---|---|---|
| 9,243,341 | B2 * | 1/2016 | Dietrich | C23C 18/1628 |
| 2002/0019197 | A1 * | 2/2002 | Sharples | B24B 37/0056 451/41 |
| 2002/0072307 | A1 * | 6/2002 | Fruitman | B24B 7/228 451/36 |
| 2002/0173232 | A1 * | 11/2002 | Laursen | B24B 37/16 451/8 |
| 2002/0173249 | A1 * | 11/2002 | Dyer | B24B 37/04 451/60 |
| 2003/0092363 | A1 * | 5/2003 | Laursen | B24B 37/26 451/41 |
| 2003/0134576 | A1 * | 7/2003 | Chadda | B24B 27/0023 451/41 |
| 2004/0063387 | A1 * | 4/2004 | Barns | B24B 37/26 451/60 |
| 2005/0092434 | A1 | 5/2005 | Korovin | |
| 2009/0042490 | A1 | 2/2009 | Muldowney | |
| 2009/0280725 | A1 | 11/2009 | Muldowney | |

OTHER PUBLICATIONS

International Preliminary Report on Patentability of International Application No. PCT/US2017/016758 (23560/PCT) dated Aug. 23, 2018.

* cited by examiner

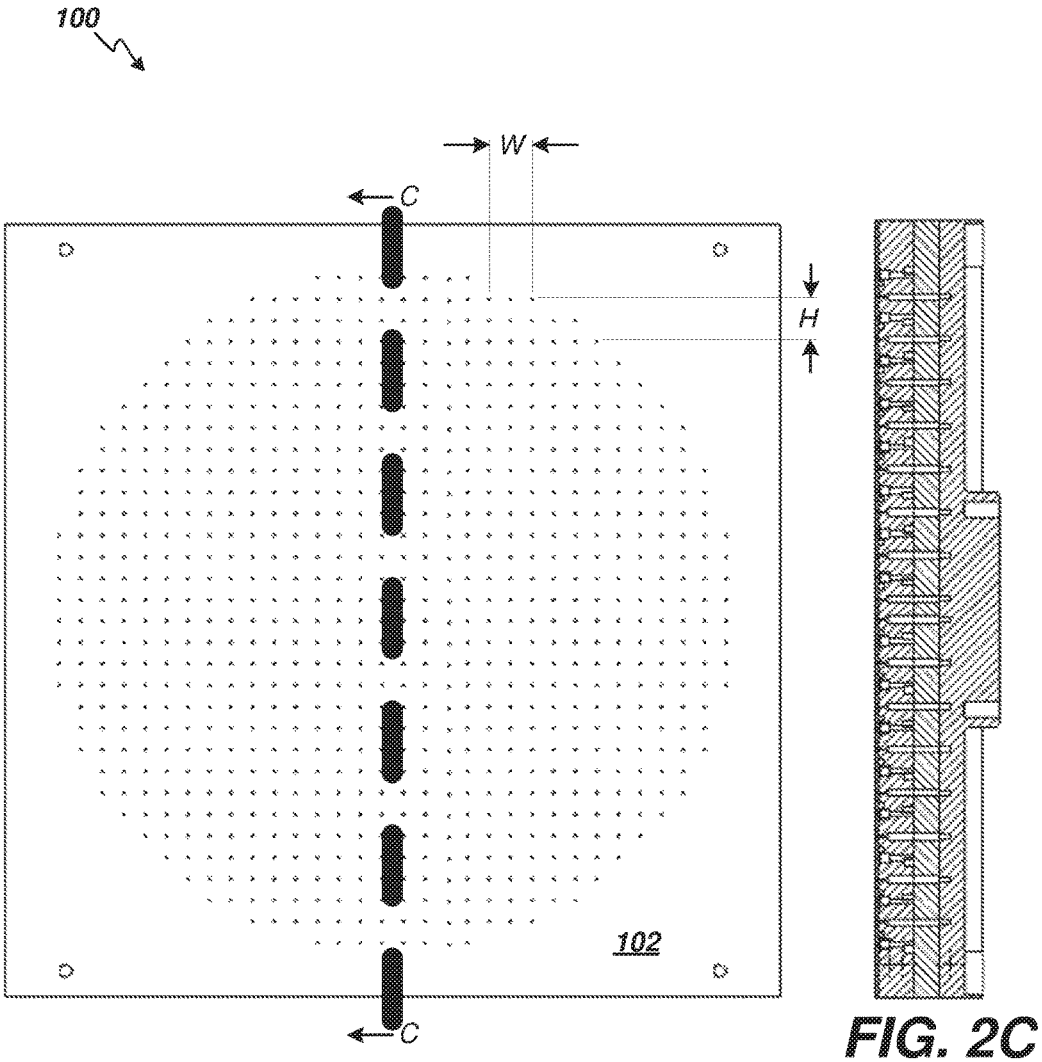
FIG. 2A
FIG. 2C
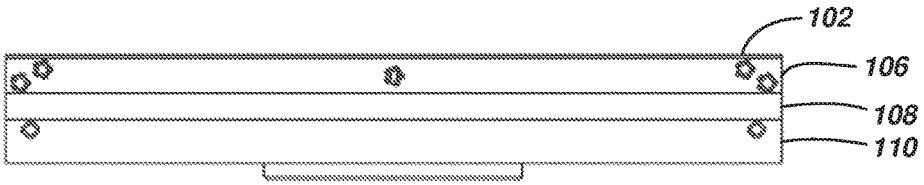
FIG. 2B

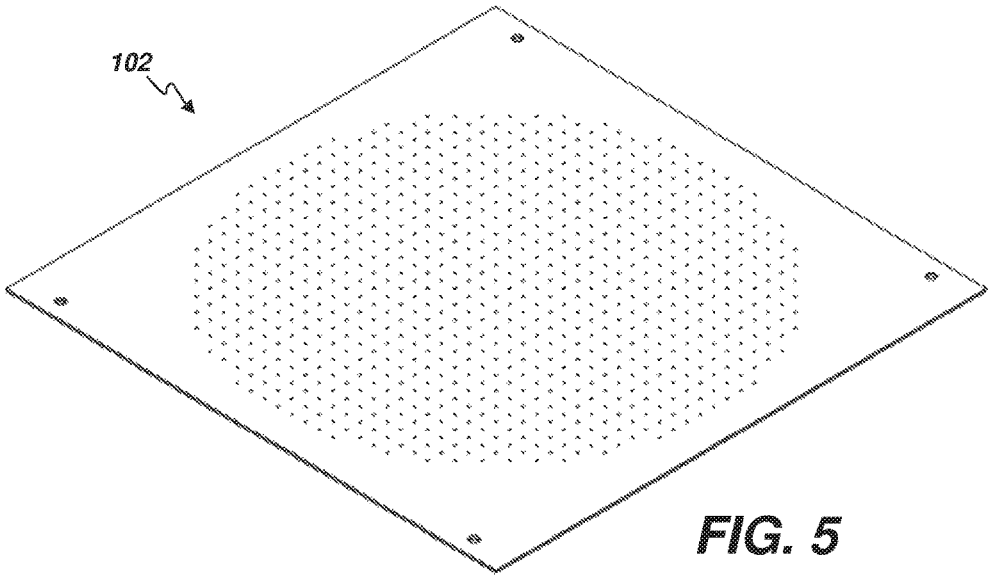
FIG. 5
FIG. 6A
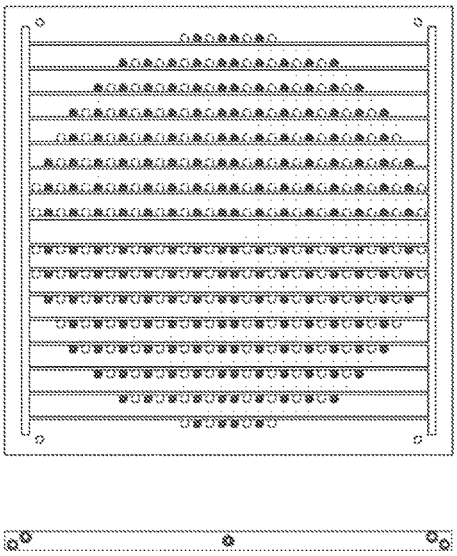
FIG. 6B
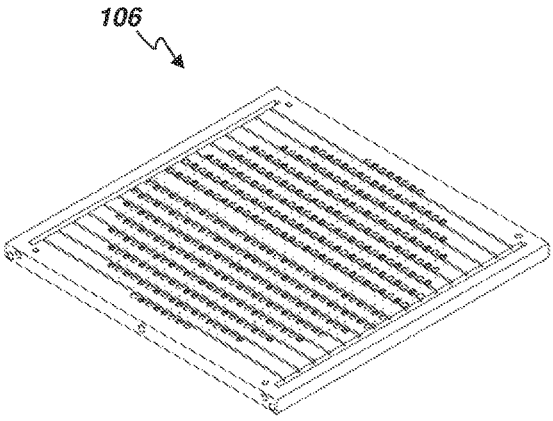
FIG. 6C

FIG. 7A
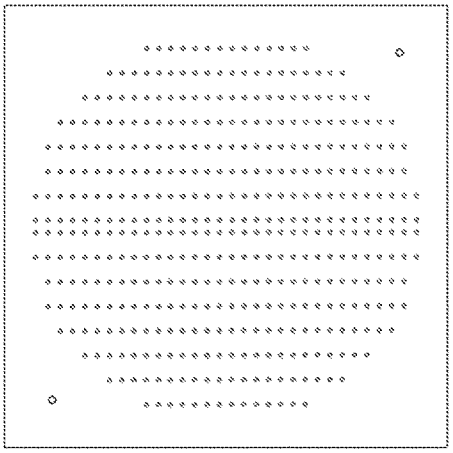
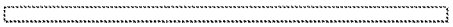
FIG. 7B
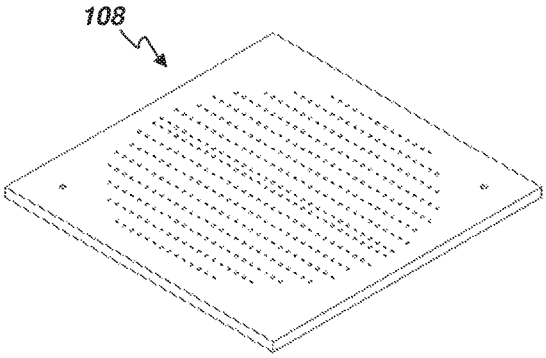
FIG. 7C
FIG. 8A
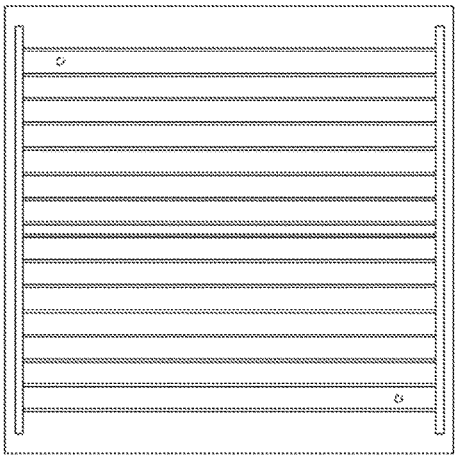
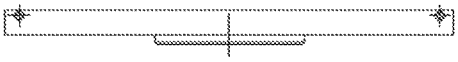
FIG. 8B
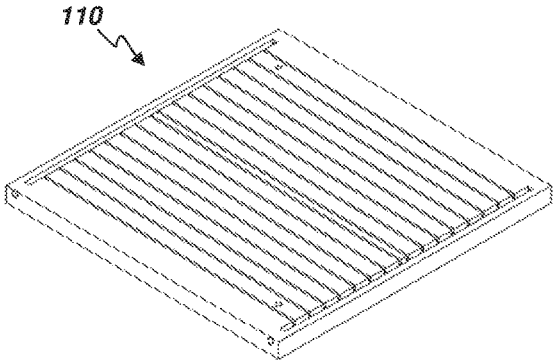
FIG. 8C

SYSTEMS, APPARATUS, AND METHODS FOR CHEMICAL POLISHING

RELATED APPLICATION

The present application claims priority to U.S. Provisional Patent Application No. 62/292,850, filed on Feb. 8, 2016, and entitled "SYSTEMS, APPARATUS, AND METHODS FOR CHEMICAL POLISHING", which is hereby incorporated herein by reference in its entirety for all purposes.

FIELD

The present invention relates to substrate polishing, and more specifically to systems, apparatus, and methods for chemical polishing.

BACKGROUND

Existing chemical mechanical polishing (CMP) material removal methods use mechanical down force to generate friction between a substrate and a polishing pad. Material removal is conventionally performed at a rate on the order of 1500 nm per minute down to 400 nm per minute. However, reducing the material removal rate below 20 nm per minute is beyond the capability of existing CMP tools primarily due to the minimum down force required to be applied to the substrate to effect any material removal. Improved device formation technologies that allow creation of ever smaller devices would benefit from the enhanced control that lower removal rates would allow but are not possible with existing CMP tools. Thus, what is needed are methods and apparatus for chemical polishing that do not rely on mechanical down force.

SUMMARY

In some embodiments, the present invention provides a fluid network platen assembly that includes a pad having a plurality of fluid openings; a network of a plurality of fluid channels, each channel in fluid communication with at least one fluid opening; a plurality of inlets, each inlet coupled to a different fluid channel; and an outlet coupled to one of the fluid channels not coupled to an inlet.

In other embodiments, the present invention provides a chemical polishing system for polishing substrates. The system includes a polishing head; an orbital actuator; and a fluid network platen assembly coupled to the orbital actuator and disposed below the polishing head, wherein the fluid network platen assembly includes a pad having a plurality of fluid openings; a network of a plurality of fluid channels, each channel in fluid communication with at least one fluid opening; a plurality of inlets, each inlet coupled to a different fluid channel; and an outlet coupled to one of the fluid channels not coupled to an inlet.

In still other embodiments, the present invention provides a method of polishing a substrate. The method includes providing a chemical polishing system including a fluid network platen assembly having a network of a plurality of fluid channels, each channel in fluid communication with at least one fluid opening in a pad coupled to the fluid network platen assembly; exposing a substrate to a thin film of a first chemical solution via the fluid network platen assembly; rinsing the substrate using a first thin film of deionized water via the fluid network platen assembly; exposing the substrate to a thin film of a second chemical solution via the fluid network platen assembly; and rinsing the substrate using a second thin film of deionized water via the fluid network platen assembly.

Other features, aspects, and advantages of the present invention will become more fully apparent from the following detailed description, the appended claims, and the accompanying drawings by illustrating a number of exemplary embodiments and implementations, including the best mode contemplated for carrying out the present invention. Embodiments of the present invention may also be capable of other and different applications, and its several details may be modified in various respects, all without departing from the spirit and scope of the present invention. Accordingly, the drawings and descriptions are to be regarded as illustrative in nature, and not as restrictive. The drawings are not necessarily drawn to scale. The description is intended to cover all modifications, equivalents, and alternatives falling within the spirit and scope of the claims.

BRIEF DESCRIPTION OF THE DRAWINGS

FIGS. 2A-2C are top, front, and composite cross-sectional views of the example embodiment of FIG. 1 according to embodiments of the present invention.

FIG. 5 is a perspective view of a pad of the example embodiment of FIG. 1 according to embodiments of the present invention.

FIGS. 6A-6C are top, front and perspective views of a top deck plate of the example embodiment of FIG. 1 according to embodiments of the present invention.

FIGS. 7A-7C are top, front and perspective views of a middle deck plate of the example embodiment of FIG. 1 according to embodiments of the present invention.

FIGS. 8A-8C are top, front and perspective views of a bottom deck plate of the example embodiment of FIG. 1 according to embodiments of the present invention.

DETAILED DESCRIPTION

Figure 1:
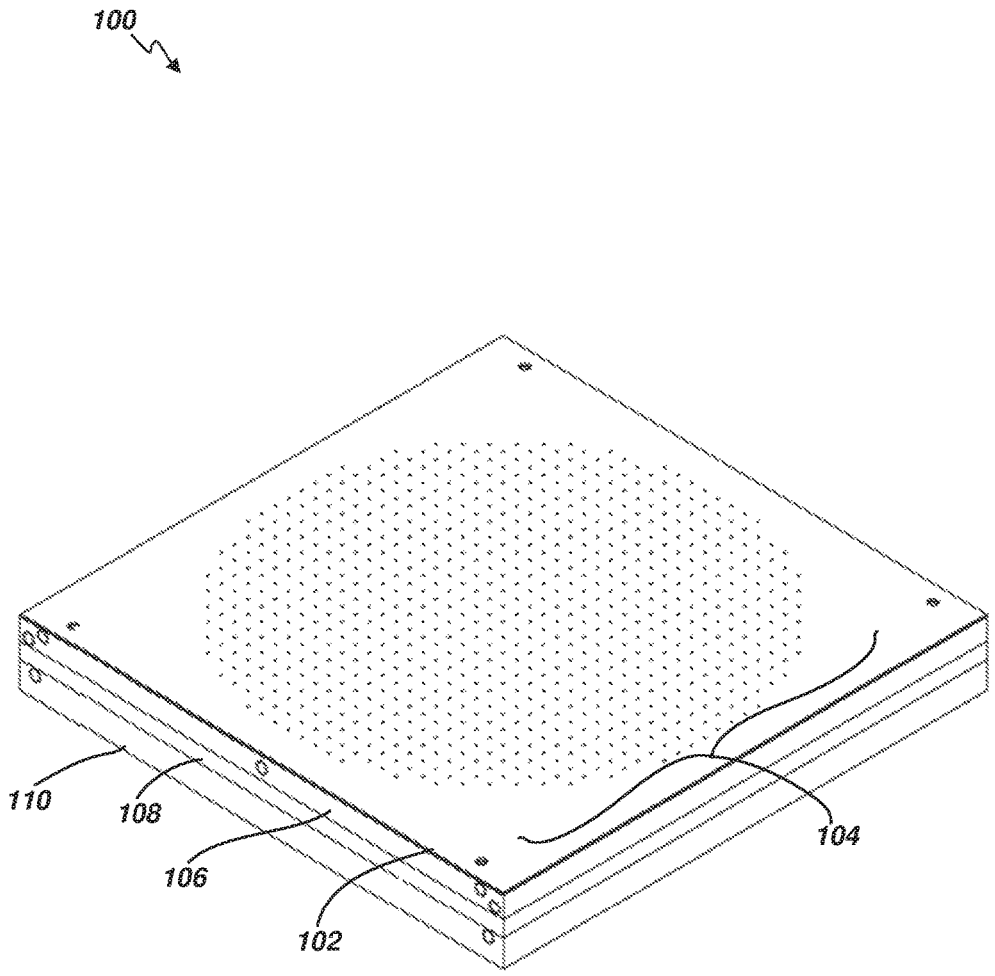
FIG. 1 is a perspective view depicting an example embodiment of a chemical polishing system according to embodiments of the present invention.

Embodiments of the present invention provide systems, apparatus, and methods for chemical polishing (e.g., nanoscale devices) that are adapted to achieve a removal rate of less that 20 nm per minute to support next generation device technologies. By polishing substrates using an exposure-based chemical etching process without applying any mechanical down force from a polishing pad, precise material removal rates can be achieved. Improved process control to within 2 nm to 4 nm, desirable for next generation devices, can be achieved with embodiments of the present invention. In other words, the height of devices on a substrate can be controlled to be within 2 nm to 4 nm using embodiments of the present invention. Example applications for such control include polishing FinFET technology devices including gate height control and lower interconnect levels where within-die (WID) control of 2 nm to 4 nm is desired.

Chemical polishing with removal rates of substantially less than 20 nm per min to achieve WID control of 2 nm to 4 nm can be realized with embodiments of the present invention using a fluid network platen assembly that exposes the substrate to an example sequence of exposures: (1) a thin film of chemical A fluid, (2) a deionized (DI) water rinse, and then (3) a thin film of chemical B fluid in a cyclic manner without any applied mechanical force. The duration of exposure of the chemicals (e.g., chemicals A and B) and the rate of change over of fluids controls the material removal rate to achieve a degree of process control to within a range of approximately 2 nm to approximately 4 nm. Example embodiments of a platen assemble with a fluid network for delivering the chemicals and water is described below with respect to the drawings.

Turning now to FIG. 1, a perspective view of an example embodiment of a fluid network platen assembly 100 for a chemical polishing system is shown. In some embodiments, the fluid network platen assembly 100 includes a pad 102 with an array of fluid channel openings 104. In some embodiments, the fluid channel openings 104 are arranged in evenly spaced rows and columns to form a circular pattern of openings with a diameter larger than a substrate (e.g., a 360 mm diameter semiconductor wafer) to be polished. For example, in some embodiments, the circular pattern of fluid channel openings 104 can have a diameter in the range of approximately 400 mm+/−10 mm to approximately 520 mm+/−10 mm or, in some embodiments, the diameter can be approximately 460 mm+/−10 mm. Other diameters can be used. The pad 102 sits upon and can be removably coupled to a top deck plate 106, which sits upon and can be permanently bonded to or removably coupled to a middle deck plate 108, which sits upon and can be permanently bonded to or removably coupled to a bottom deck plate 110. In some embodiments, the deck plates can be constructed from a plastic polymer such as polyvinyl chloride (PVC) or any other practicable material that is non-reactive with the chemical solutions to be used for chemical polishing.

FIGS. 2A-2C illustrate top, front, and composite cross-sectional views of the fluid network platen assembly 100. FIG. 2C is a composite cross-section of the fluid network platen assembly 100 taken along the width of line CC in FIG. 2A. A network of fluid channels within the fluid network platen assembly 100 can be seen in FIG. 2C wherein individual nozzles are aligned with the fluid channel openings 104 in the pad 102. As shown, the rows of fluid channel openings 104 correspond to alternate fluid channels within the fluid network platen assembly 100. Thus, the fluid channels are spaced apart by a distance H in one direction and by a distance W in a perpendicular direction. In some embodiments, H can be in the range of approximately 15 mm+/−2 mm to approximately 35 mm+/−2 mm or, in some embodiments, approximately 25 mm+/−2 mm. In some embodiments, W can be in the range of approximately 15 mm+/−2 mm to approximately 35 mm+/−2 mm or, in some embodiments, approximately 25 mm+/−2 mm. Other dimensions are possible. In some embodiments, H and W can be approximately equal and in others, H and W can be different. The dimensions given are selected to allow even, consistent, and uniform application of a thin film of one or more chemical solutions to the major surface of a substrate being processed.

Figure 3:
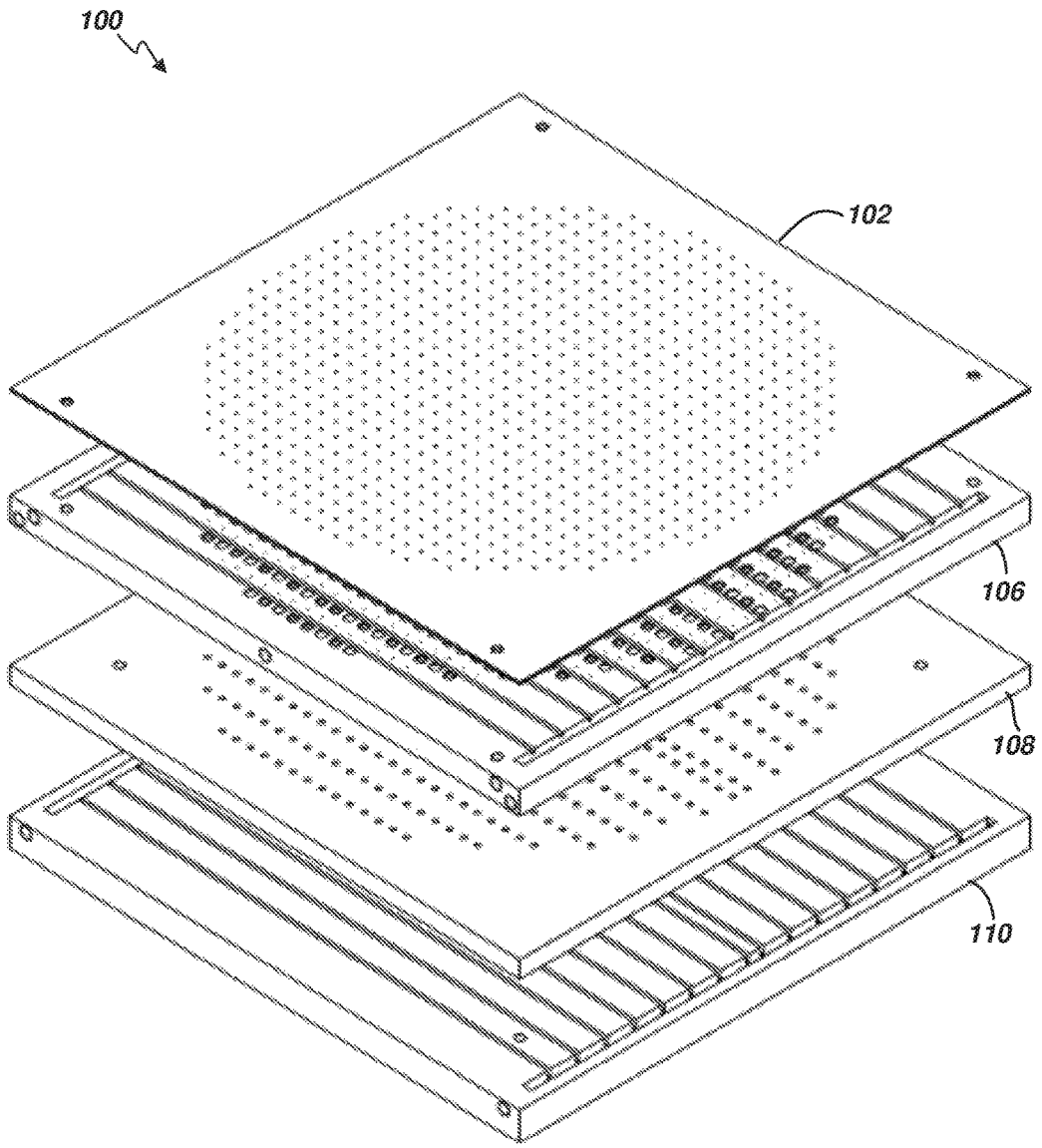
FIG. 3 is an exploded top perspective view of the example embodiment of FIG. 1 according to embodiments of the present invention.
Figure 4:
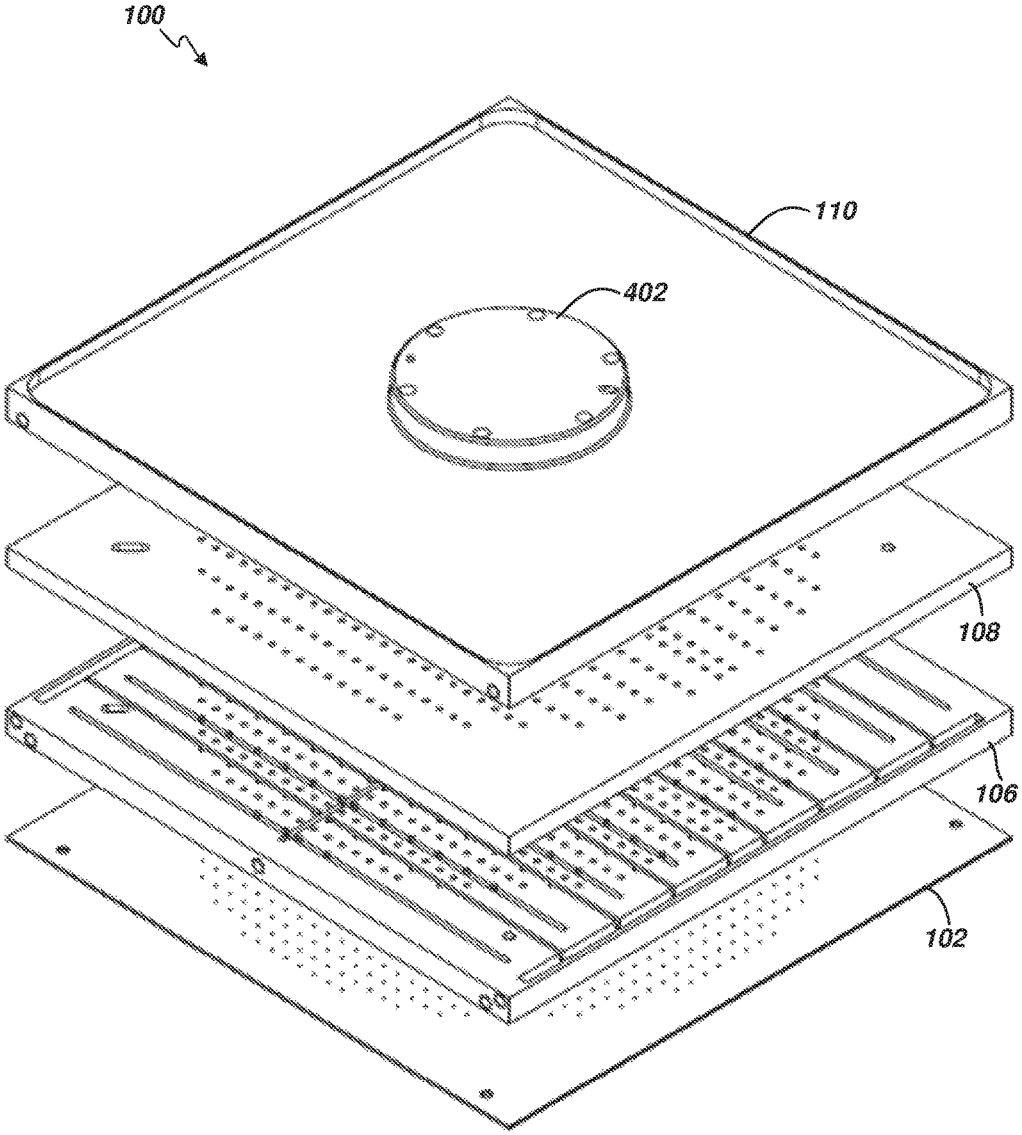
FIG. 4 is an exploded bottom perspective view of the example embodiment of FIG. 1 according to embodiments of the present invention.

FIGS. 3 and 4 are exploded perspective views of the fluid network platen assembly 100. FIG. 3 is a top view and FIG. 4 is a bottom view. As can be seen, the bottom deck 110 includes a mounting disk 402 that is used to couple the fluid network platen assembly 100 to an orbital motion actuator (not shown in FIG. 4 but see FIG. 11B described below). Also as can be seen, the top deck plate 106, middle deck plate 108, and bottom deck plate 110 each include an array of aligned channels that collectively form the network of fluid channels within the fluid network platen assembly 100 when the various plates are coupled or bonded together.

Figure 9:
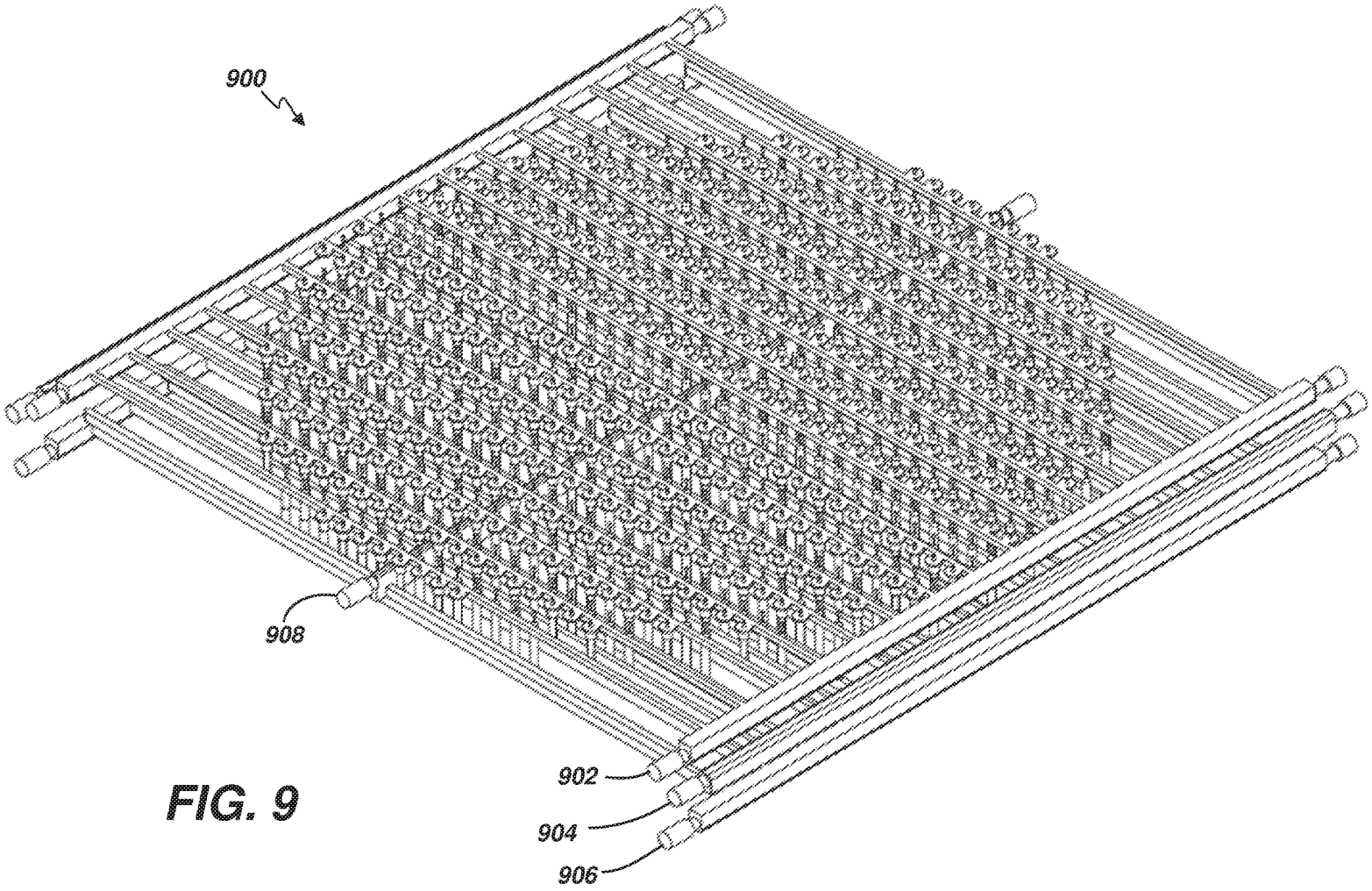
FIG. 9 is a composite perspective view of internal fluid channel networks of the example embodiment of FIG. 1 according to embodiments of the present invention.

FIG. 5 is a perspective view of the pad 102 upon which the substrate is placed for processing. FIGS. 6A-6C are top, front and perspective views respectively of an example of the top deck plate 106 of the fluid network platen assembly 100. FIGS. 7A-7C are top, front and perspective views of an example of the middle deck plate 108 of the fluid network platen assembly 100. FIGS. 8A-8C are top, front and perspective views of an example of the bottom deck plate 110 of the fluid network platen assembly 100. FIG. 9 depicts a perspective view of the fluid network 900 that is formed by the collective arrays of aligned channels within the fluid network platen assembly 100. Note the four connectors for adding fluid to, or removing fluid from, the fluid network platen assembly 100. The drain channel outlet connector 902 can be coupled to a flexible vacuum line for drawing fluid down from the pad 102 and out of the fluid network platen assembly 100. Chemistry A channel inlet connector 908 can be coupled to a flexible chemical A supply line (not shown). Likewise, Chemistry B channel inlet connector 904 can be coupled to a flexible chemical B supply line (not shown). Rinse channel inlet connector 906 can be coupled to a flexible deionized water (DIW) supply line.

Figure 10A:
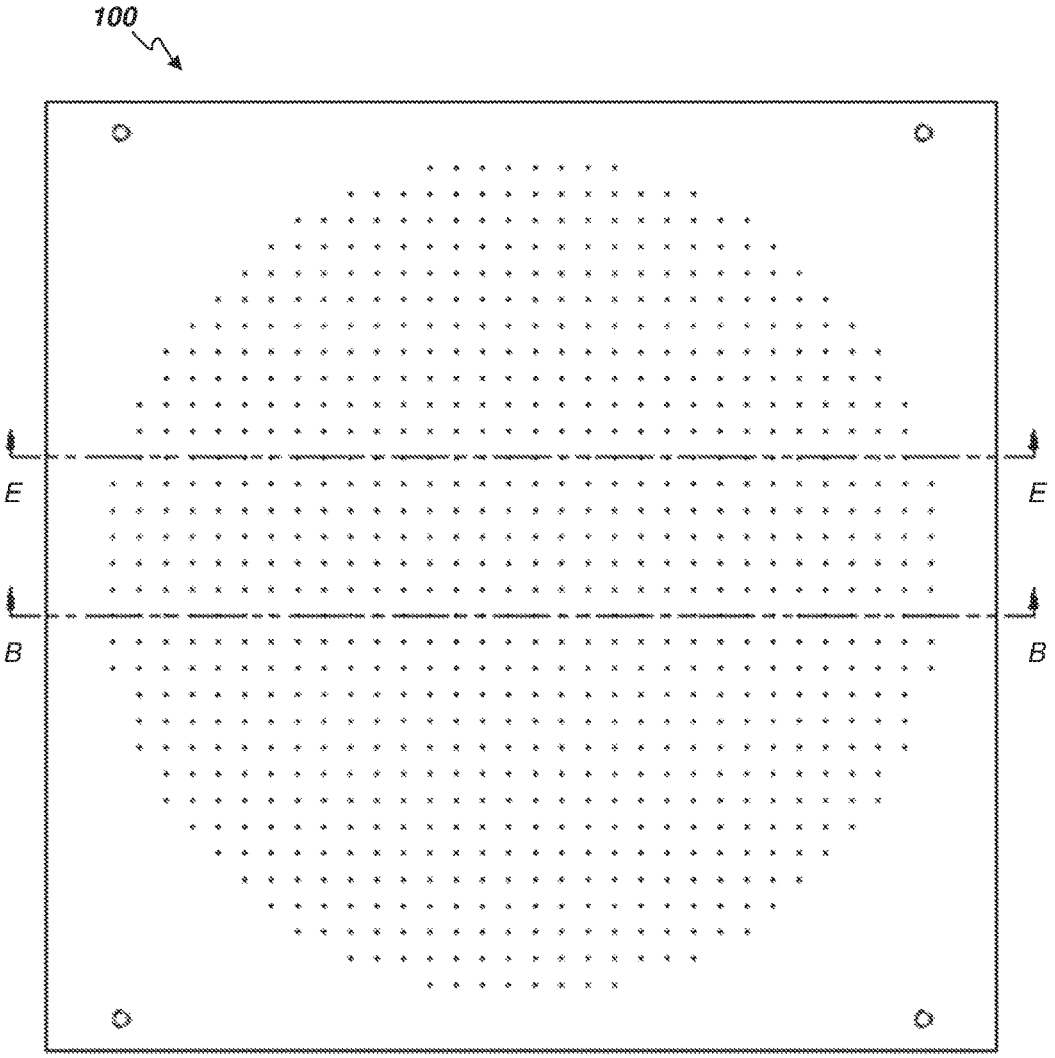
FIG. 10A is a top view of the example embodiment of FIG. 1 according to embodiments of the present invention.
Figure 10B:
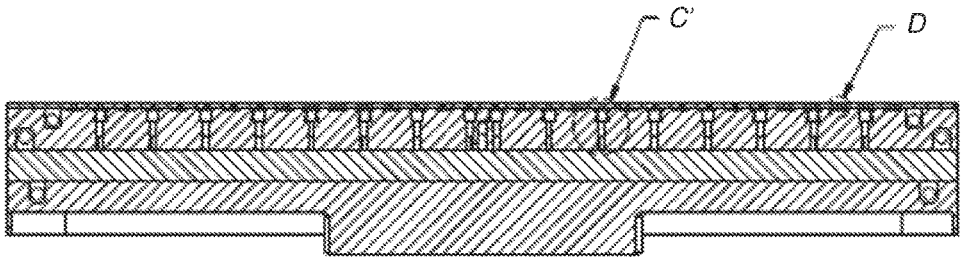
FIG. 10B is a cross-sectional view taken alone line BB in FIG. 10A according to embodiments of the present invention.
Figure 10C:
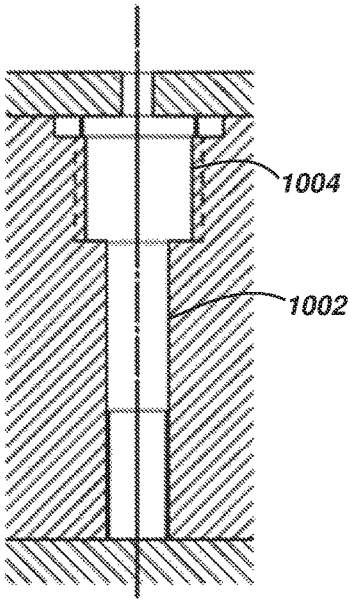
FIG. 10C is a magnified cross-sectional detail view of encircled portion C' of FIG. 10B according to embodiments of the present invention.
Figure 10D:
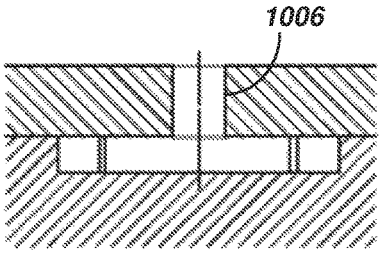
FIG. 10D is a magnified cross-sectional detail view of encircled portion D of FIG. 10B according to embodiments of the present invention.
Figure 10E:
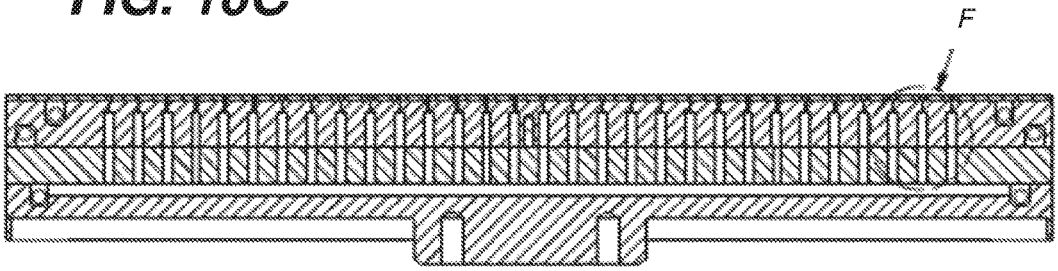
FIG. 10E is a cross-sectional view taken alone line EE in FIG. 10A according to embodiments of the present invention.
Figure 10F:
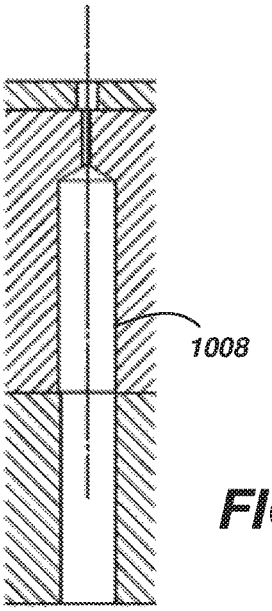
FIG. 10F is a magnified cross-sectional detail view of encircled portion F of FIG. 10E according to embodiments of the present invention.

Turning now to FIGS. 10A-10F, details of the fluid network platen assembly 100 are further illustrated. FIG. 10B is a cross-sectional view of the fluid network platen assembly 100 taken at line BB in FIG. 10A. FIG. 10C depicts a magnified cross-sectional detail view of an example chemical A or B fluid channel 1002 within the encircled portion C' of FIG. 10B. In some embodiments, all or part of the fluid channel 1002 can be formed by a removable tubular insert 1004 that is replaceable. Thus, if the fluid channel 1002 becomes clogged, the clog can easily be eliminated by simply replacing the removable tubular insert 1004. In some embodiments, the removable tubular insert 1004 has a diameter of approximately 0.5 mm. Other diameters can be used. FIG. 10D depicts a magnified cross-sectional detail view of an example drain channel 1006 within the encircled portion D of FIG. 10B. FIG. 10E is a cross-sectional view of the fluid network platen assembly 100 taken at line EE in FIG. 10A. FIG. 10F depicts a magnified cross-sectional detail view of an example DIW fluid channel 1008 within the encircled portion F of FIG. 10E. In some embodiments, the DIW fluid channel 1008 has a diameter of approximately 0.5 mm. Other diameters can be used.

In some embodiments, the DIW fluid channel 1008 can be in fluid communication with approximately 412 fluid channel openings 104. These openings 104 can be approximately 1 mm in diameter. The flow rate through each of these individual openings 104 can be less than or equal to approximately 8 ml per minute. The fluid pressure at the rinse channel inlet connector 906 can be in the range of approximately 10 psi+/−5 psi to approximately 60 psi+/−5 psi. The total in-flow at the inlet of the rinse channel inlet connector 906 can be approximately 3000 ml per minute.

In some embodiments, the Chemistry A channel inlet connector 908 can be in fluid communication with approximately 92 channel openings 104. These openings 104 can be approximately 1 mm in diameter. The flow rate through each of these individual openings 104 can be less than or equal to approximately 32.5 ml per minute. The fluid pressure at the Chemistry A channel inlet connector 908 can be in the range of approximately 10 psi+/−5 psi to approximately 60 psi+/−5 psi. The total in-flow at the inlet of the Chemistry A channel inlet connector 908 can be approximately 3000 ml per minute.

In some embodiments, the Chemistry B channel inlet connector 904 can be in fluid communication with approximately 108 channel openings 104. These openings 104 can be approximately 1 mm in diameter. The flow rate through each of these individual openings 104 can be less than or equal to approximately 27.5 ml per minute. The fluid pressure at the Chemistry B channel inlet connector 904 can be in the range of approximately 10 psi+/−5 psi to approximately 60 psi+/−5 psi. The total in-flow at the inlet of the Chemistry B channel inlet connector 904 can be approximately 3000 ml per minute.

In some embodiments, the drain channel outlet connector 902 can be in fluid communication with approximately 184 channel openings 104. These openings 104 can be approximately 1 mm in diameter. The flow rate through each of these individual openings 104 can be less than or equal to approximately 30 ml per minute. The pump pressure drawing in fluid from the pad 102 can be in the range of approximately 10 psi+/−5 psi to approximately 60 psi+/−5 psi. The total discharge rate at the drain outlet of the drain channel outlet connector 902 can be approximately less than or equal to 5000 ml per minute.

Figure 11A:
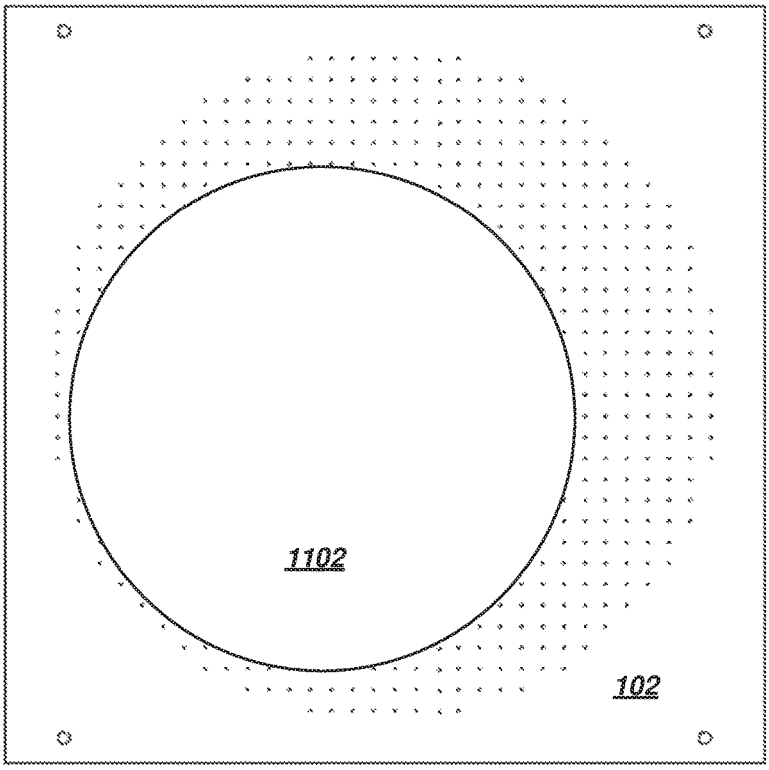
FIG. 11A is a top view of the example embodiment of FIG. 1 with a substrate represented according to embodiments of the present invention.
Figure 11B:
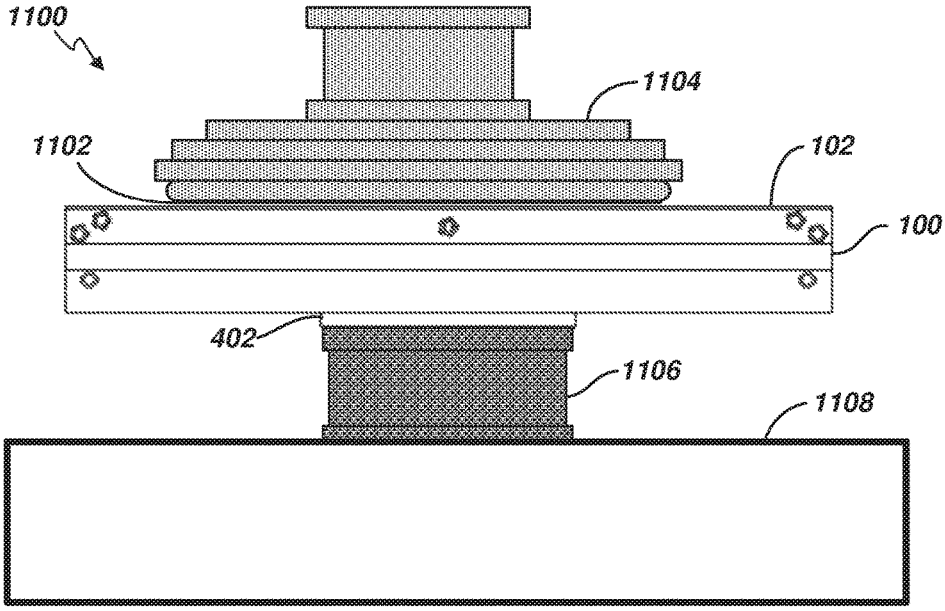
FIG. 11B is a side view of the example embodiment of FIG. 1 with a substrate, a polishing head, and an orbital actuator represented according to embodiments of the present invention.

FIG. 11A is a top view of the example fluid network platen assembly 100 with a substrate 1102 represented on the pad 102. FIG. 11B is a side view of a chemical polishing system 1100 including the fluid network platen assembly 100, a polishing head 1104, and an orbital actuator 1108 coupled to the fluid network platen assembly 100 via a mounting disk 402 and a linkage 1106. As shown in FIG. 11A, the substrate 1102 is positioned with its center offset from the center of the pad 102. In some embodiments, the center of the substrate 1102 is offset approximately 50 mm+/−10 mm from the center of the pad 102. Other offset amounts can be used.

In operation, the substrate 1102 is held securely and rotated by the polishing head 1104 in close proximity to the pad 102 without applying down force against the pad 102. While the fluid network platen assembly 100 is moved in an orbital motion (without rotation) by the orbital actuator 1108, a predefined sequence of chemical solutions and DIW are sequentially output and removed from the pad 102 and the surface of the substrate 1102. A thin film of fluid is formed between the pad 102 and the substrate 1102 such that the substrate need not contact the pad 102 to contact the fluid film.

In some embodiments, the polishing head 1104 rotates in the range of approximately 0+/−5 revolutions per minute to approximately 500+/−5 revolutions per minute. Other rotation rates can be used. In some embodiments, the fluid network platen assembly 100 is orbited within a frequency range of approximately 0+/−5 cycles per minute to approximately 500+/−5 cycles per minute. Other orbit frequencies can be used. In some embodiments, the polishing head 1104 and the fluid network platen assembly 100 move in opposing directions while in other embodiments, they move in non-opposing directions. In some embodiments, the amount of offset between the center of the polishing head 1104 and the center of the fluid network platen assembly 100 can be variable and/or adjustable before or during processing. For example, the fluid network platen assembly 100 can be configured to be offset from the center of the polishing head 1104 within the range of approximately 0+/−0.5 inches to approximately 2+/−0.5 inches. Other offset values can be used. In some embodiments, the offset can be configured to be adjustable in discrete increments (e.g., eight) within the specified range. In some embodiments, the offset can be configured to be infinitely adjustable within the specified range. The switching time period (e.g., the length of exposure) of the chemical solutions and DIW to the substrate 1102 can vary in the range of approximately 0+/−2 seconds to approximate 60+/−2 seconds. Other exposure time periods can be used.

In some embodiments, the processing of the substrate can include a sequence of exposures each intended to effect a functional and/or structural change to the substrate. For example, in a first exposure to a chemical solution, formation of metal oxide using $H_2O_2$ can be followed by formation of a reinforced film by an inhibitor. In a second exposure, removal of the reinforced film from relatively high spots by erosive action can be effected. In a third exposure, dissolution of oxide film by complexing can be effected and reformation of a reinforced film can also be effected. In a forth exposure, global planarization and material removal can be effected.

Figure 12:
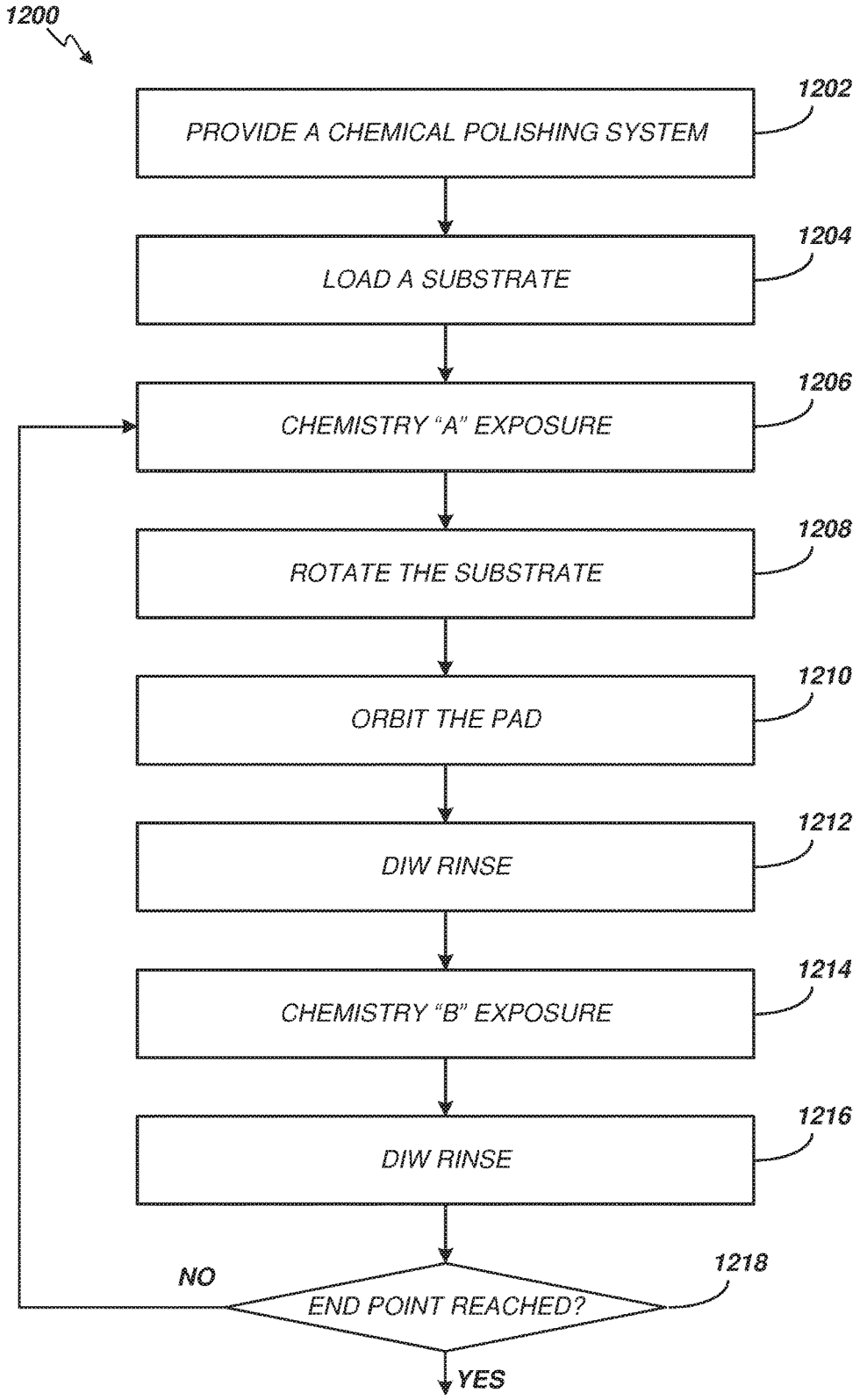
FIG. 12 is a flowchart depicting an example method of chemical polishing according to embodiments of the present invention.

Turning now to FIG. 12, a flowchart depicting an example method 1200 of chemical polishing according to embodiments of the present invention is provided. A chemical polishing system including a fluid network platen assembly and a polishing head is provided (1202). A substrate is secured by the polishing head and brought proximate to the fluid network platen (1204). A thin film of a first chemistry (Chemistry A) is formed by the fluid network platen between the substrate and the fluid network platen in contact with the substrate for a predefined exposure time period (1206). The polishing head is rotated (1208). The fluid network platen is orbited about a point offset from the center of the substrate (1210). A thin film of DIW is formed by the fluid network platen between the substrate and the fluid network platen in contact with the substrate for a predefined exposure time period (1212). A thin film of a second chemistry (Chemistry B) is formed by the fluid network platen between the substrate and the fluid network platen in contact with the substrate for a predefined exposure time period (1214). A thin film of DIW is formed by the fluid network platen between the substrate and the fluid network platen in contact with the substrate for a predefined exposure time period (1216). A determination is made if the polishing endpoint has been reached (1218). If yes, processing completes and if not, flow loops back to performing the Chemistry A exposure 1206.

In some embodiments, the chemistry exposures can be thought of as pulses that are applied to the substrate. For example, an oxidation pulse using a first chemistry can be applied for a specific time increment, and then after a rinse pulse (e.g., with DIW) is applied, an abrasive pulse can be applied to the substrate for a specific time increment. The oxidation pulse can be, for example, a concentration in the range of approximately 0.1% to approximately 1% (or approximately 0.25%) of $H_2O_2$ and/or a concentration in the range of 0.001% to approximately 0.1% (or approximately 0.05%) of benzotriazole (BTA). In some embodiments, tetradecylthioacetic acid (TTA) can be used instead of BTA. The abrasive pulse can be a concentration of $SiO_2$ in the range of approximately 0.005 wt % to approximately 0.05 wt % (or approximately 0.01 wt %) and approximately 0.05 wt % to approximately 0.5 wt % (or approximately 0.1 wt %) of ammonium citrate or other carboxylic acids such as oxalic acid, etc., can be used.

Numerous embodiments are described in this disclosure, and are presented for illustrative purposes only. The described embodiments are not, and are not intended to be, limiting in any sense. The presently disclosed invention embodiments are widely applicable to numerous implementations, as is readily apparent from the disclosure. One of ordinary skill in the art will recognize that the disclosed embodiments may be practiced with various modifications and alterations, such as structural, logical, software, and electrical modifications. Although particular features of the disclosed embodiments may be described with reference to one or more particular configurations and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments. The Title (set forth at the beginning of the first page of this disclosure) is not to be taken as limiting in any way as the scope of the disclosed embodiments of the inventions.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application.

The foregoing description discloses only example embodiments of the invention. Modifications of the above-disclosed apparatus, systems and methods which fall within the scope of the invention will be readily apparent to those of ordinary skill in the art.

Accordingly, while the present invention has been disclosed in connection with exemplary embodiments thereof, it should be understood that other embodiments may fall within the spirit and scope of the invention, as defined by the following claims.

The invention claimed is:

1. A fluid network platen assembly comprising:

a pad having a plurality of fluid openings;

a network of a plurality of fluid channels arranged to distribute a fluid laterally across at least a portion of the fluid network platen assembly, each fluid channel in fluid communication with at least one fluid opening;

a plurality of inlets located on an exterior of the fluid network platen assembly, wherein one or more fluid channels are coupled to two or more inlets; and an outlet coupled to one of the fluid channels not coupled to one of the plurality of inlets.

2. The fluid network platen assembly of claim 1 wherein the network of the plurality of fluid channels is formed from a plurality of platens, each platen having an array of aligned channels.

3. The fluid network platen assembly of claim 1 wherein the plurality of fluid openings are disposed in a circular pattern having a diameter larger than a substrate to be processed.

4. The fluid network platen assembly of claim 1 wherein the plurality of inlets include two first inlets for a first chemistry channel; two or more second inlets for a second chemistry channel; and two or more third inlets for a rinse channel.

5. The fluid network platen assembly of claim 1 wherein the outlet is coupled to a fluid pump and is operative to function as a drain.

6. The fluid network platen assembly of claim 1 further including a mounting disk for coupling the fluid network platen assembly to an orbital actuator.

7. The fluid network platen assembly of claim 1 wherein at least some of the plurality of fluid channels include removable tubular inserts.

8. A chemical polishing system for polishing substrates, the system comprising:

a polishing head;

an orbital actuator; and a fluid network platen assembly coupled to the orbital actuator and disposed below the polishing head, wherein the fluid network platen assembly includes a pad having a plurality of fluid openings; a network of a plurality of fluid channels arranged to distribute a fluid laterally across at least a portion of the fluid network platen assembly, each fluid channel in fluid communication with at least one fluid opening; a plurality of inlets located on an exterior of the fluid network platen assembly, wherein one or more fluid channels are coupled to two or more inlets; and an outlet coupled to one of the fluid channels not coupled to one of the plurality of inlets.

9. The chemical polishing system of claim 8 wherein the network of the plurality of fluid channels is formed from a plurality of platens, each platen having an array of aligned channels.

10. The chemical polishing system of claim 8 wherein the plurality of fluid openings are disposed in a circular pattern having a diameter larger than a substrate to be processed.

11. The chemical polishing system of claim 8 wherein the plurality of inlets include two first inlets for a first chemistry channel; two or more second inlets for a second chemistry channel; and two or more third inlets for a rinse channel.

12. The chemical polishing system of claim 8 wherein the outlet is coupled to a fluid pump and is operative to function as a drain.

13. The chemical polishing system of claim 8 further including a mounting disk for coupling the fluid network platen assembly to an orbital actuator.

14. The chemical polishing system of claim 8 wherein at least some of the plurality of fluid channels include removable tubular inserts.

15. A method of polishing a substrate, the method comprising:

providing a chemical polishing system including a fluid network platen assembly having a network of a plurality of fluid channels arranged to distribute a fluid laterally across at least a portion of the fluid network platen assembly, each fluid channel in fluid communication with at least one fluid opening in a pad coupled to the fluid network platen assembly;

providing a plurality of inlets located on an exterior of the fluid network platen assembly, wherein one or more fluid channels channel are coupled to two or more inlets;

exposing a substrate to a thin film of a first chemical solution via the fluid network platen assembly;

rinsing the substrate using a first thin film of deionized water via the fluid network platen assembly;

exposing the substrate to a thin film of a second chemical solution via the fluid network platen assembly;

rinsing the substrate using a second thin film of deionized water via the fluid network platen assembly; and removing at least one of the first chemical solution, the second chemical solution, and the deionized water through an outlet coupled to one of the fluid channels not coupled to one of the plurality of inlets.

16. The method of claim 15 further comprising rotating the substrate proximate to the fluid network platen assembly so as to contact each of the thin films.

17. The method of claim 16 further comprising orbiting the fluid network platen assembly.

18. The method of claim 17 wherein a center of the fluid network platen assembly is offset from a center of the substrate.

19. The method of claim 15 further comprising repeating the exposing and the rinsing until an endpoint is reached.

20. The method of claim 15 wherein the exposing is performed for a predefined amount of time.

* * * * *